US011103738B2

(12) United States Patent
Sorin et al.

(10) Patent No.: US 11,103,738 B2
(45) Date of Patent: Aug. 31, 2021

(54) MOVEABLE RACK MOUNT APPARATUS AND METHODS OF USING SAME

(71) Applicants: Albert Sorin, Lexington, SC (US); Richard Sorin, Lexington, SC (US)

(72) Inventors: Albert Sorin, Lexington, SC (US); Richard Sorin, Lexington, SC (US)

( * ) Notice: Subject to any disclaimer, the term of this patent is extended or adjusted under 35 U.S.C. 154(b) by 0 days.

(21) Appl. No.: 16/619,797

(22) PCT Filed: May 8, 2018

(86) PCT No.: PCT/US2018/031596
§ 371 (c)(1),
(2) Date: Dec. 5, 2019

(87) PCT Pub. No.: WO2018/208772
PCT Pub. Date: Nov. 15, 2018

(65) Prior Publication Data

US 2020/0139186 A1 May 7, 2020

Related U.S. Application Data

(60) Provisional application No. 62/503,233, filed on May 8, 2017.

(51) Int. Cl.
*A63B 21/06* (2006.01)
*A63B 21/00* (2006.01)
(Continued)

(52) U.S. Cl.
CPC .... *A63B 21/0615* (2013.01); *A63B 21/00181* (2013.01); *A63B 21/08* (2013.01);
(Continued)

(58) Field of Classification Search
CPC ..... A61B 21/0615; A61B 21/4035; A61B 21/00181; A61B 21/08; A61B 71/0054; A61B 21/0724; A61B 2225/09
(Continued)

(56) References Cited

U.S. PATENT DOCUMENTS 4,492,375 A * 1/1985 Connelly ..... A63B 21/055 482/130
4,582,320 A * 4/1986 Shaw ..... A63B 21/00072 482/130
(Continued)

OTHER PUBLICATIONS

International Search Report and Written Opinion issued in counterpart PCT Application No. PCT/US2018/031596 dated Aug. 1, 2018 (nine (9) pages).
(Continued)

*Primary Examiner* — Nyca T Nguyen
*Assistant Examiner* — Andrew M Kobylarz
(74) *Attorney, Agent, or Firm* — Todd Allen Serbin; Nexsen Pruet, LLC

(57) ABSTRACT

A moveable rack mount apparatus for use with an exercise rack constructed of at least one rack tube configured with at least one rack hole, comprising: a tube passage sized and shaped for slidable passage therethrough of the rack tube; a reversible locking mechanism configured to engage the at least one rack hole of the rack tube when the rack tube is in the tube passage; at least one attachment hole for securing at least one of a plurality of interchangeable exercise-related attachments to the moveable rack mount apparatus.

22 Claims, 11 Drawing Sheets

(51) Int. Cl.
*A63B 21/08* (2006.01)
*A63B 71/00* (2006.01)
*A63B 21/072* (2006.01)

(52) U.S. Cl.
CPC ..... *A63B 21/4035* (2015.10); *A63B 71/0054* (2013.01); *A63B 21/0724* (2013.01); *A63B 2225/09* (2013.01)

(58) Field of Classification Search
USPC ..... 248/224.8, 225.11, 223.21, 220.31
See application file for complete search history.

(56) References Cited

U.S. PATENT DOCUMENTS

| | | | | |
|---|---|---|---|---|
| 4,596,484 | A | 6/1986 | Nakatani | |
| 5,529,558 | A * | 6/1996 | Koenig | A63B 21/0615 482/137 |
| 5,570,957 | A | 11/1996 | Kuly et al. | |
| 5,688,216 | A * | 11/1997 | Mauriello | A63B 21/154 482/101 |
| 6,551,226 | B1 | 4/2003 | Webber et al. | |
| 8,047,972 | B1 * | 11/2011 | Dean | A63B 21/169 482/104 |
| 8,834,328 | B1 | 9/2014 | Batca | |
| 10,272,287 | B1 * | 4/2019 | Rector | A63B 22/0694 |
| 2007/0054785 | A1 * | 3/2007 | Drechsler | A63B 21/078 482/94 |
| 2007/0155596 | A1 * | 7/2007 | Rogers | A63B 21/4047 482/97 |
| 2010/0048367 | A1 | 2/2010 | Liang et al. | |
| 2010/0048368 | A1 | 2/2010 | Donofrio | |
| 2017/0065844 | A1 | 3/2017 | Hopperstad | |

OTHER PUBLICATIONS

International Preliminary Report on Patentability issued in counterpart PCT Application No. PCT/US2018/031596 dated Aug. 15, 2019 (fifteen (15) pages).

"Bodycraft f430 power rack." Retrieved Nov. 25, 2018. URL: https://www.bodycraft.com/f430-power-rack.html.

"BodyCraft F432 Dip bars." Retrieved Nov. 26, 2018. URL: https://www.bodycraft.com/media/catalog/producVcache/1/image/546x450/9df7 8eab33525d08d6e5fb8d27136e95/w /e/web f432_dip _dg .jpg.

"BodySolid PPR-82A parts diagram." Parts Diagram Images. Retrieved Nov. 25, 2018. URL: https :/ /www.fitnessrepairparts .com/diagram/ 1 0885.

"BodySolid PPR-82A parts diagram." Parts Diagram Drawing& Retrieved Nov. 26, 2018. URL: https :/ /www.fitnessrepairparts .com/diagram/ 1 0885.

"Body Solid tensioning handle." Retrieved Nov. 26, 2018. URL: https:/ /www .bodysolid .co.uk/ ALL -BODY -SOLID-POP-PINS-AND-HARDWARE/Body-Solid-T-Pop-pin-82500 12_p-1 07 4-846. aspx.

TuffStuff Fitness. "PXLS7910 half rack." Product Video. Retrieved Nov. 26, 2018. URL: https://youtu.be/U2ZHG8qS-28.

"TuffStuff Fitness PXLS 7910 half rack." Images and Product Video. Retrieved Nov. 26, 2018. URL: https :/ /www.tuffstuffitness.com/producVpxls-791 0-half-rack/.

Rogue Fitness Monster Trolley Facebook post. Jun. 7, 2012.

PCT Third Party Observation issued in counterpart PCT Application No. PCT/US2018/031596 dated Nov. 26, 2018 (seven (7) pages).

* cited by examiner

MOVEABLE RACK MOUNT APPARATUS AND METHODS OF USING SAME

RELATED APPLICATION

This application is a U.S. national phase application, claiming priority under 35 U.S.C. 371 to PCT application PCT/US2018/031596, filed on May 8, 2018, which claimed the benefit of priority under Article 8 PCT of U.S. Provisional Patent Application No. 62/503,233 filed May 8, 2017, the contents of which are incorporated herein by reference in their entireties.

FIELD AND BACKGROUND OF THE INVENTION

The present invention, in some embodiments thereof, relates to exercise and, more particularly, but not exclusively, to exercise equipment.

SUMMARY OF THE INVENTION

There is provided in accordance with an aspect of an exemplary embodiment of the invention, a moveable rack mount apparatus for use with an exercise rack constructed of at least one rack tube configured with at least one rack hole, comprising: a tube passage sized and shaped for slidable passage therethrough of the rack tube; a reversible locking mechanism configured to engage the at least one rack hole of the rack tube when the rack tube is in the tube passage; at least one attachment hole for securing at least one of a plurality of interchangeable exercise-related attachments to the moveable rack mount apparatus.

In an embodiment of the invention, the apparatus further comprises a tensioning handle shaped to reversibly apply compressive force on the rack tube when placed in a tensioned position.

In an embodiment of the invention, the apparatus further comprises at least one band attachment point.

In an embodiment of the invention, the reversible locking mechanism comprises a pop pin.

In an embodiment of the invention, the apparatus further comprises an engagement pin portion of the pop pin which is configured to engage the rack hole.

In an embodiment of the invention, the apparatus further comprises a pin handle attached to the pop pin.

In an embodiment of the invention, the reversible locking mechanism comprises a hitch pin.

In an embodiment of the invention, the apparatus further comprises an adjustment handle.

In an embodiment of the invention, the apparatus further comprises at least one protective roller disposed proximal to the tube passage such that the rack tube when in the tube passage abuts the protective roller.

In an embodiment of the invention, the at least one protective roller is at least one smooth and flexible.

In an embodiment of the invention, the apparatus further comprises at least one sleeve on an interior surface of the tube passage.

In an embodiment of the invention, the apparatus further comprises a plurality of pin holes for insertion of at least one reversible locking mechanism.

There is provided in accordance with an aspect of an exemplary embodiment of the invention, a method of using a moveable rack mount apparatus for use with an exercise rack constructed of at least one rack tube configured with at least one rack hole, comprising: sliding the moveable rack mount apparatus along the rack tube to a desire position with the reversible locking mechanism disengaged; and, releasing the reversible locking mechanism such that movement between the moveable rack mount apparatus and the rack is prevented.

In an embodiment of the invention, the method further comprises transitioning a tensioning handle of the apparatus to a tensioned position.

In an embodiment of the invention, the method further comprises attaching the moveable rack mount apparatus to the exercise rack prior to final assembly of the exercise rack.

In an embodiment of the invention, the method further comprises securing at least one exercise-related attachment to the apparatus.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings and images. With specific reference now to the drawings in detail, it is stressed that the particulars shown are by way of example, are not necessarily to scale, and are for purposes of illustrative discussion of embodiments of the invention. In this regard, the description taken with the drawings makes apparent to those skilled in the art how embodiments of the invention may be practiced.

In the drawings.

DETAILED DESCRIPTION

Figure 1A:
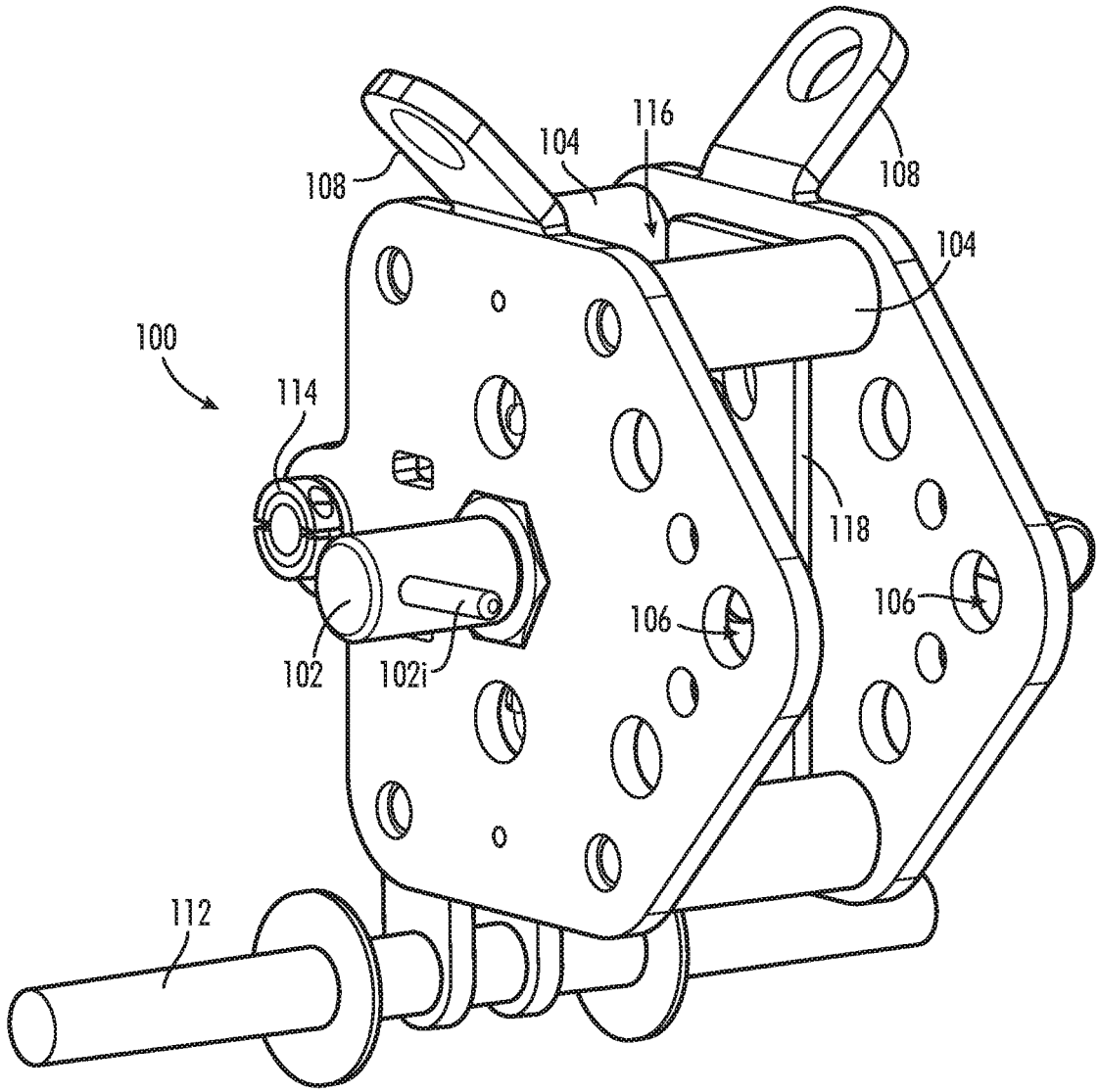
FIGS. 1A-1B are front and rear perspective views, respectively, of a moveable rack mount apparatus, in accordance with an exemplary embodiment of the invention.

The present invention, in some embodiments thereof, relates to exercise and, more particularly, but not exclusively, to exercise equipment.

Generally, a mechanism (i.e. the moveable rack mount apparatus described herein) is provided that is designed to enable the connection of various exercise attachments to a "rack", a frame used for manual exercises on which different kinds of exercise equipment can be attached to facilitate the exercises, while also making movement of the connection mechanism convenient, safe and easy, without the need of any additional and/or separate tools.

In an accordance with an aspect of an exemplary embodiment of the invention, a moveable rack mount apparatus is provided which connects at least one exercise-related attachment to an exercise rack, wherein the apparatus can be moved from one position on the exercise rack to another position on the exercise rack without the use of special or additional tools and without having to remove the apparatus from the rack for the re-positioning. Further, it is conceived that different interchangeable attachments are usable with the apparatus so that they can be connected to the rack. In some embodiments, the apparatus is configured with reversible components (e.g. adjustment handle, pop pin) so that the apparatus can be adapted for use on the right and/or left of the user during exercise. In some embodiments, the apparatus is configured with a left side layout and a right side layout. In some embodiments, at least one of each is used on a rack when connecting an exercise-related attachment. Optionally, the exercise-related attachment is connected to the rack using only a single right side layout, left side layout or reversible apparatus. In some embodiments, the apparatus includes a reversible tensioning handle to tighten the apparatus on to the rack, to reduce movement of the apparatus during exercise.

In an accordance with a further aspect of an exemplary embodiment of the invention, a method for using a moveable rack mount apparatus is provided. The moveable rack mount apparatus is configured to be slidable on an exercise rack and then temporarily and immovably engaged with the rack by release of a pop pin or attachment of a hitch pin. Optionally, a tensioning handle is used to further reinforce the engagement of the apparatus to the rack by transitioning from an un-tensioned configuration to a tensioned configuration. An exercise-related attachment is reversibly attached to the apparatus, for the user to interact with during exercise. When a new exercise is desired, for example an exercise at a different angular incidence to the user, movement of the apparatus is instigated by reversing the order of actions. Releasing the tensioning handle, disengaging the pop pin, then sliding the apparatus to the new desired position on the rack.

Before explaining at least one embodiment of the invention in detail, it is to be understood that the invention is not necessarily limited in its application to the details of construction and the arrangement of the components and/or methods set forth in the following description and/or illustrated in the drawings and/or images. The invention is capable of other embodiments or of being practiced or carried out in various ways.

Figure 1B:
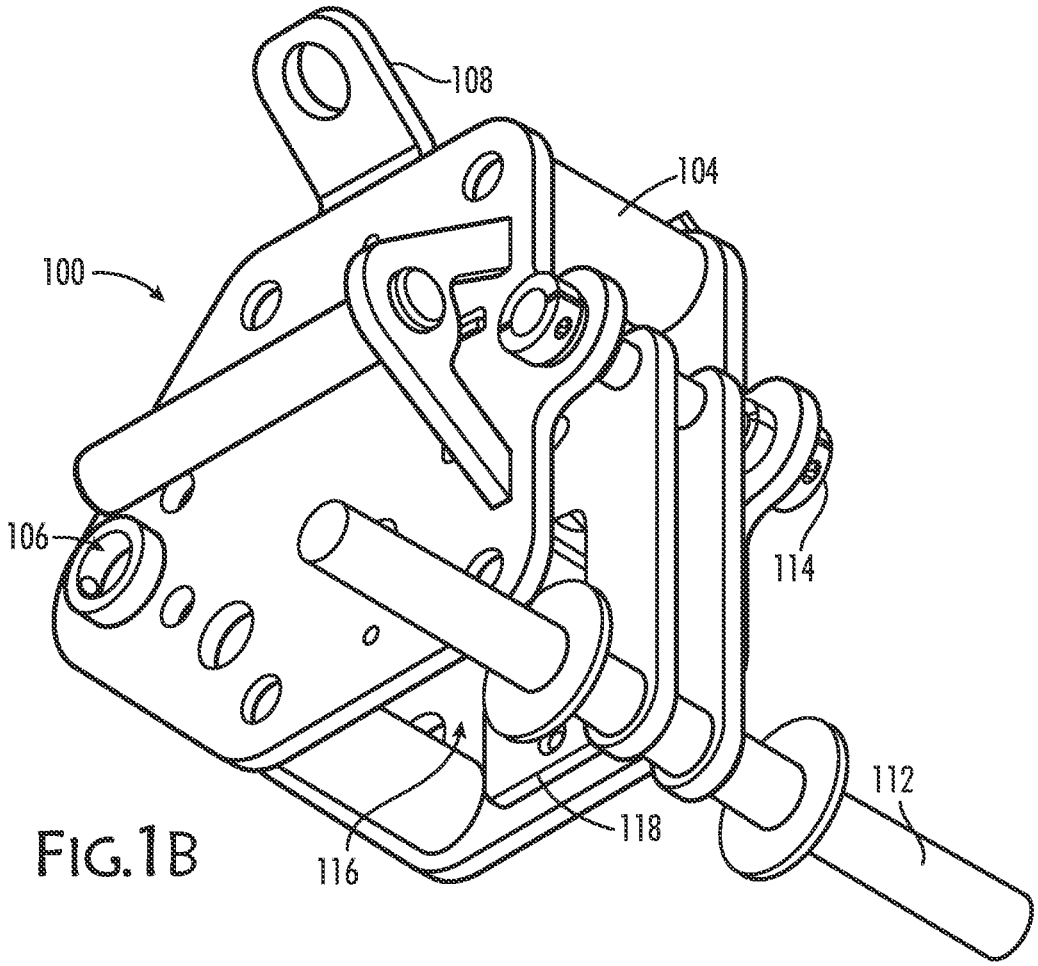

Referring now to the drawings, FIG. 1A is a front, perspective view of a moveable rack mount apparatus 100 and FIG. 1B is a rear, perspective view of the mount apparatus 100, in accordance with an exemplary embodiment of the invention. In an embodiment, the moveable rack mount apparatus 100 is used to connect exercise-related attachments to a rack, such as the XL™ Series, Dark Horse™, Base Camp™, and BaseFit™ racks offered by Sorinex Exercise Equipment, Inc, and/or for example, any 3 in.×3 in. rack tube, 2 in.×2 in. rack tube, 2 in.×3 in. rack tube, regardless of gauge or thickness, and as shown in FIGS. 3-7 and 10. Exercise racks often include rack tubing with holes for adjustable placement of exercise-related attachments. Conventionally, these attachments are connected to the rack by screwing them onto the rack using conventional screws/nuts/bolts, which pass through the holes, and the associated hand tools for accomplishing this.

The moveable rack mount apparatus 100 is provided with a releasably locking mechanism, such as a pop pin 102 which can be pulled out and popped back into a hole in the rack. Optionally, the pop pin 102 is biased (e.g. spring-loaded) in a locked or closed configuration, wherein the pop pin 102 is located in the hole, not out of it. In some embodiments, the pop pin 102 is provided with a pin handle 102*i* to assist with pulling the pop pin 102 out of the hole in the rack. In some embodiments of the invention, the releasably locking mechanism is a hitch style pin instead of, or in addition to, a spring-loaded pop pin.

The moveable rack mount apparatus 100 is configured to be slidable on the tubing of the rack when the pop pin 102 is not engaged with a hole, for example having a tube passage 116 disposed vertically and/or entirely through the apparatus 100 and/or by being provided with protective rollers 104 as the interface between the apparatus 100 and the rack. In some embodiments, the protective rollers 104 are at least coated, if not made from, a smooth and/or slightly flexible material like plastic, foam or rubber. In some embodiments the protective rollers 104 roll as the apparatus 100 is moved up and/or down (or sideways if the rack tubing is horizontal to the floor) the rack tubing.

Figure 6:
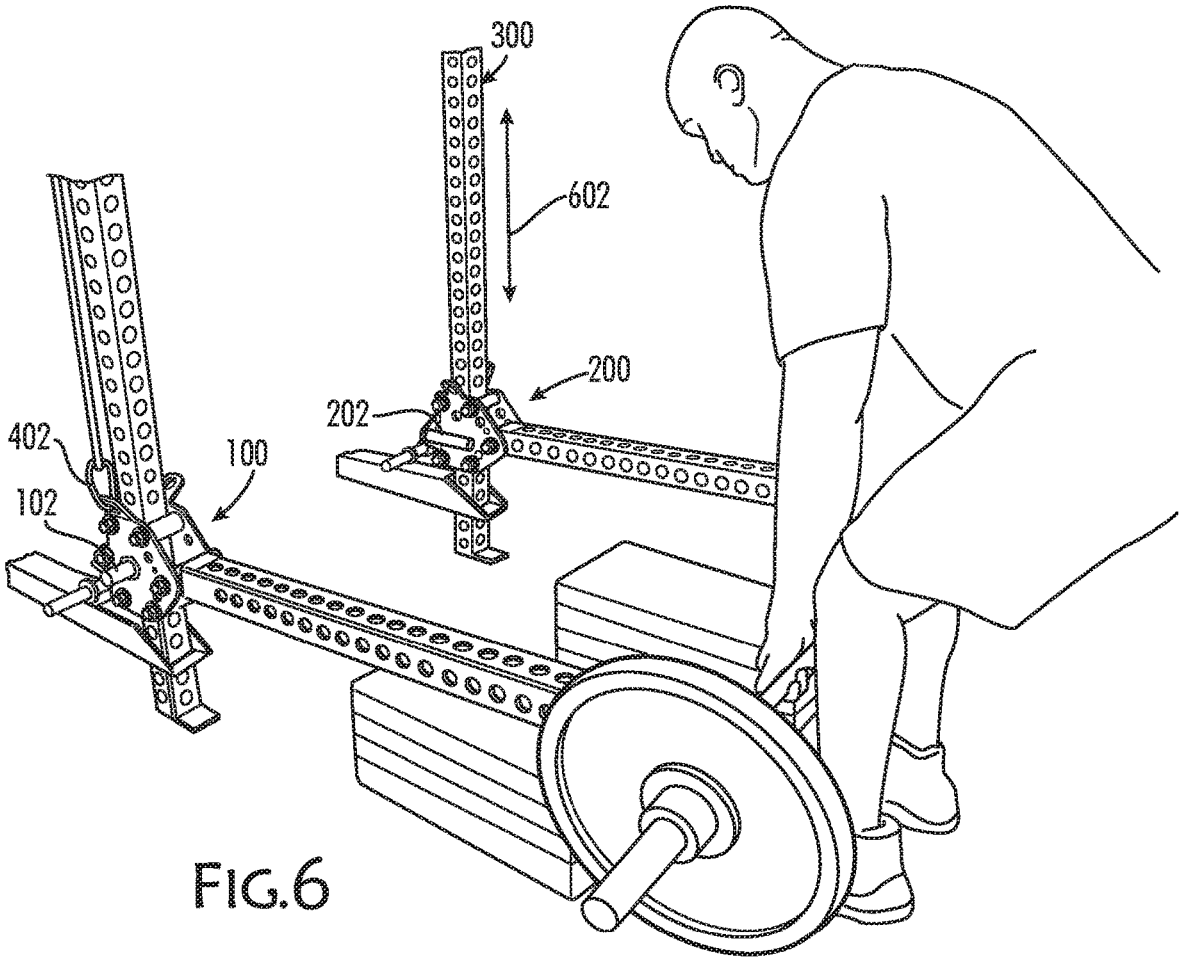
FIG. 6 is an image of two moveable rack mount apparatuses in use, in accordance with an exemplary embodiment of the invention.
Figure 7:
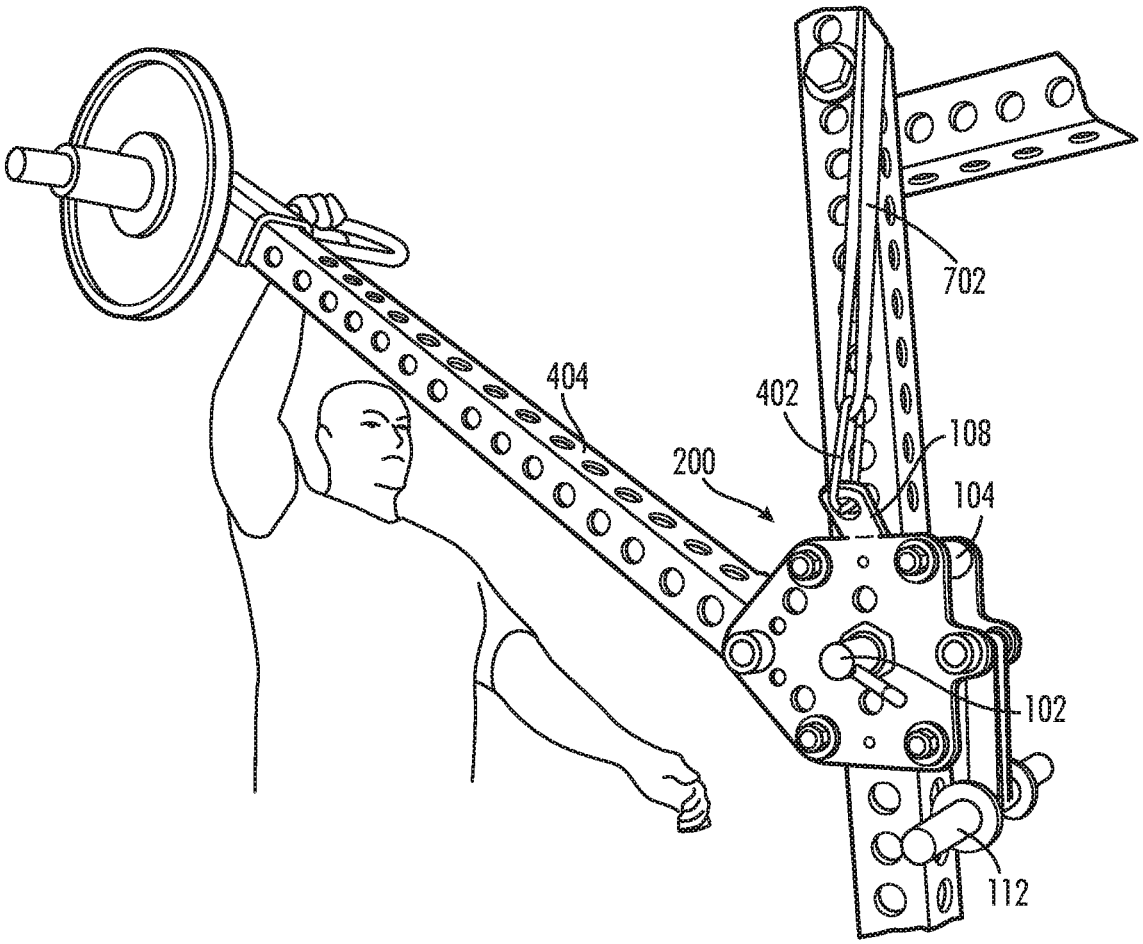
FIG. 7 is an image of a moveable rack mount apparatus in use, in accordance with an exemplary embodiment of the invention.

As described herein, the apparatus 100 is primarily used for connecting exercise-related attachments to a rack. In some embodiments, the apparatus 100 is used in pairs, for example for each side of a rack (such as shown in FIG. 6). Optionally, just a single apparatus 100 is used (such as shown in FIG. 7). Just like conventional racks have holes, many exercise-related attachments are also configured with holes to assist with connection to a rack. In some embodiments, the apparatus 100 is provided with at least one attachment hole 106, which corresponds to a hole in the exercise-related attachment, through which a pin or pivot rod is placed to secure the exercise-related attachment to the rack. Optionally, the exercise-related attachment is free to pivot around the central axis of the attachment holes 106 when connected to the rack by the apparatus 100.

In some embodiments of the invention, the apparatus 100 is configured with at least one band assist attachment point 108 for attaching or clipping a band or strap thereto. Optionally, the band or strap is elastic and when attached to the apparatus 100 on one end of the band and to the top of the rack and/or additional band attachment point on the other end, the elasticity of the band helps to "lift" the apparatus 100 up the rack tubing when heavy exercise-related attachments are connected to the apparatus 100. In some embodiments, the band is inelastic and is used as a safety precaution to prevent the apparatus 100 from sliding on the rack tube in the event of failure of some component of the apparatus 100.

In some embodiments of the invention, the apparatus is provided with multiple pin holes 110, through which the pop pin 102 can be inserted to connect the apparatus 100 to the rack. Optionally, a plurality of pop pins 102 are used at the same time, utilizing a plurality of the pin holes 110.

The apparatus 100 is provided with a tightening mechanism comprising a tensioning handle 112 which pivots/rotates around a tension pivot 114 connected to the apparatus 100. In an embodiment of the invention, the tightening mechanism is configured with a shape that tightens the fit between the apparatus 100 and the rack when the tensioning handle 112 is transitioned from an un-tensioned position (for example, an up position) to a tensioned position (for example, a down position), such as shown in FIG. 1A. For example, rotating the tensioning handle 112 applies a cam-like action (e.g. rotational motion of the handle 112 is translated to linear motion) to a grip pad, which compresses the grip pad onto the rack tube. It should be understood that use of the tightening mechanism is optional, as the apparatus 100 will still be locked to the rack by the pop pin 102 engaged through a rack hole regardless of the tightness of fit between them.

In some embodiments, at least one sleeve 118 is provided to an interior surface of the apparatus 100 in the tube passage 116 which abuts the rack tubing to provide a smooth sliding surface and/or to protect the rack tubing and/or to protect the apparatus 100 during movement of the apparatus 100 relative to the rack and/or to provide a tighter fit between the apparatus 100 and the rack. In some embodiments, the tube passage 116 and/or the apparatus 100 is constructed oversized to accommodate a wide range of rack tube sizes, where sleeves 118 of varying thickness are interchangeably used to vary the tightness fit between the apparatus 100 and sizes of the rack tube smaller than the tube passage 116.

In some embodiments, the interchangeability afforded by the apparatus permits the relatively easy replacement of attachments which wear through use.

Figure 2A:
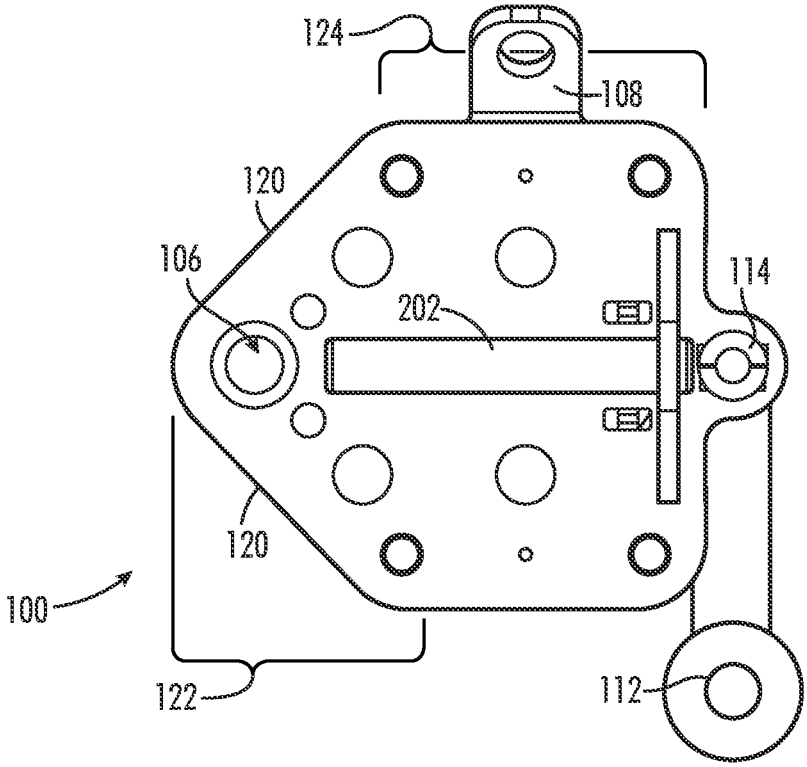
FIGS. 2A-2C are right side, bottom, and rear, views, respectively, of the moveable rack mount apparatus of FIGS. 1A-1B, in accordance with an exemplary embodiment of the invention.
Figure 2B:
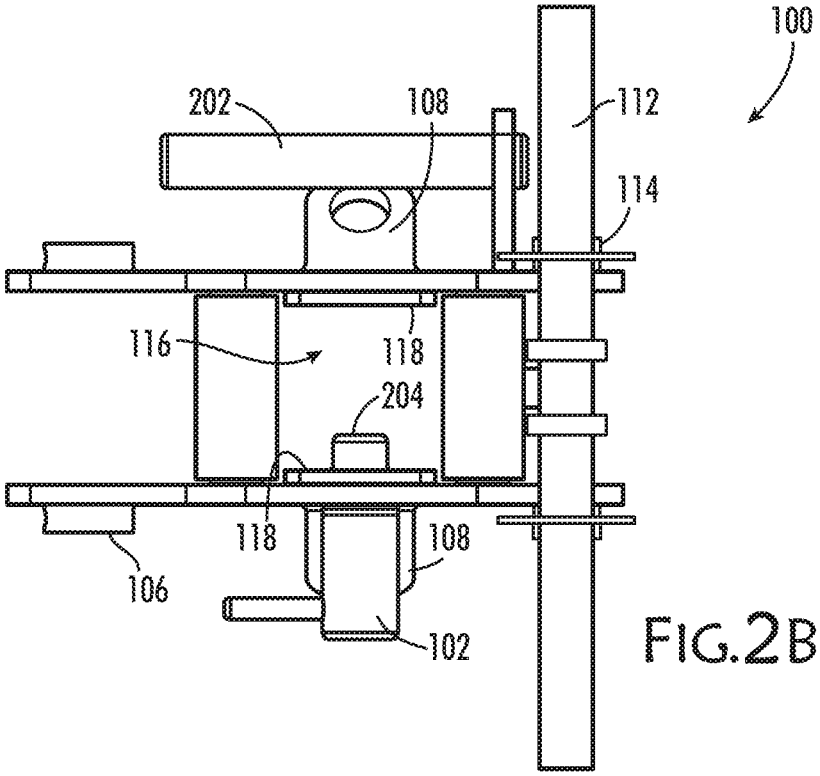
Figure 2C:
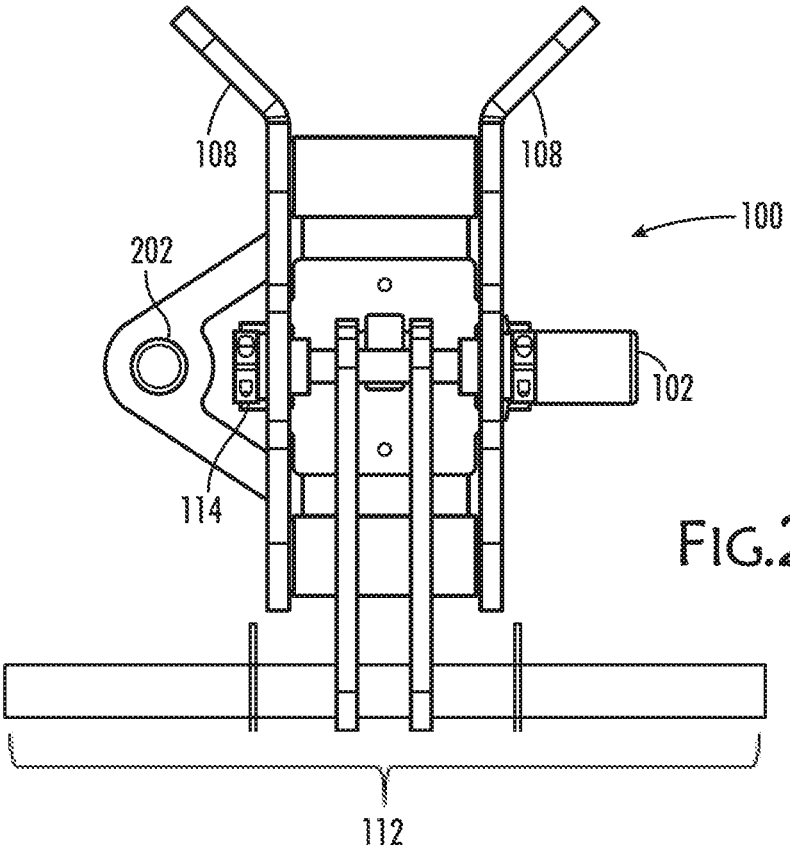

FIGS. 2A-2C are right side, bottom, and rear views, respectively, of moveable rack mount apparatus 100, in accordance with an exemplary embodiment of the invention. FIG. 2A shows an adjustment handle 202 which can be gripped by a user to help move the apparatus 100 along the rack tubing for positioning the apparatus 100 thereon. Exemplary measurements are also provided, 9 inches in a height dimension and 8.33 inches in a depth dimension, but it should be understood that these are by way of example only. FIG. 2A shows tapering 120 of the front of a blunted triangle portion 122 of a main body of the apparatus 100. In an embodiment of the invention, the apparatus 100 is generally configured with the blunted triangle portion 122 abutting one side of a quadrilateral portion 124 of the main body.

Figure 9:
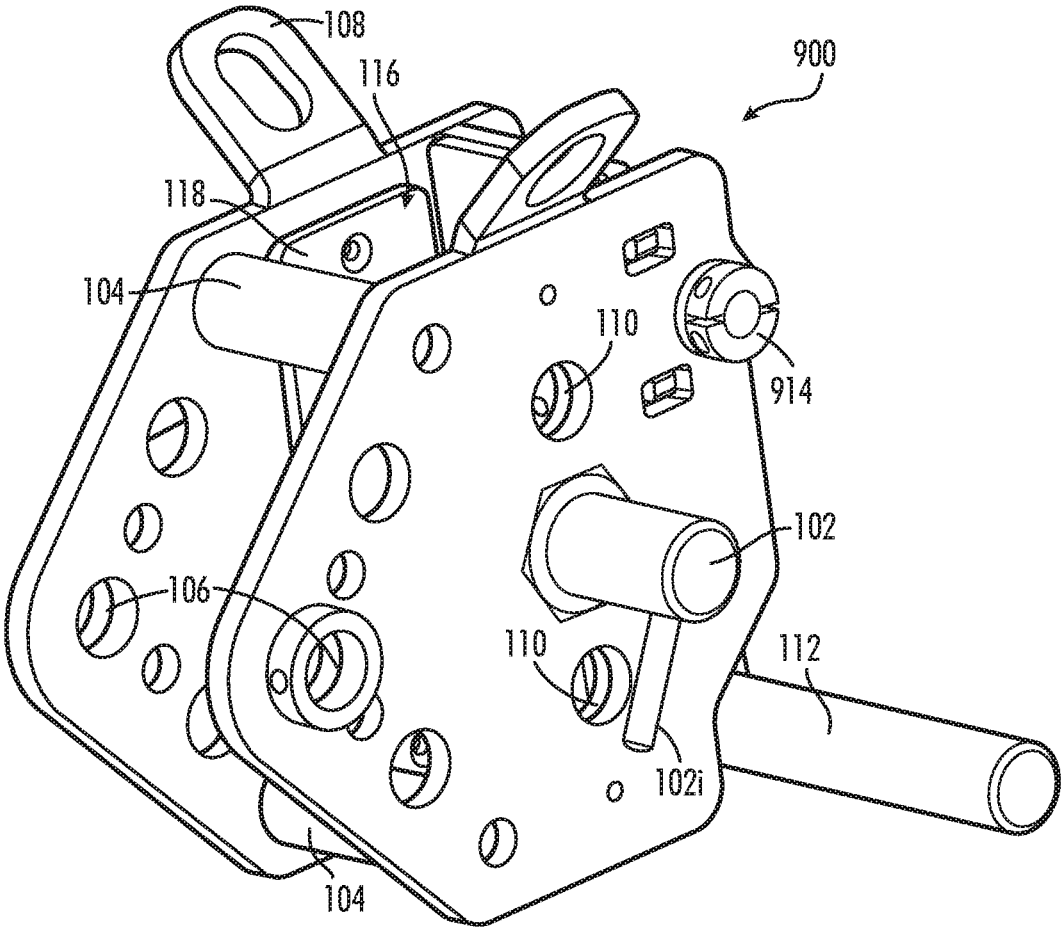
FIG. 9 is a front, perspective view of a moveable rack mount apparatus, in accordance with an exemplary embodiment of the invention; and, FIG. 10 is a perspective view of a moveable rack mount apparatus mounting a lever arm to a rack, in accordance with an exemplary embodiment of the invention.
Figure 10:
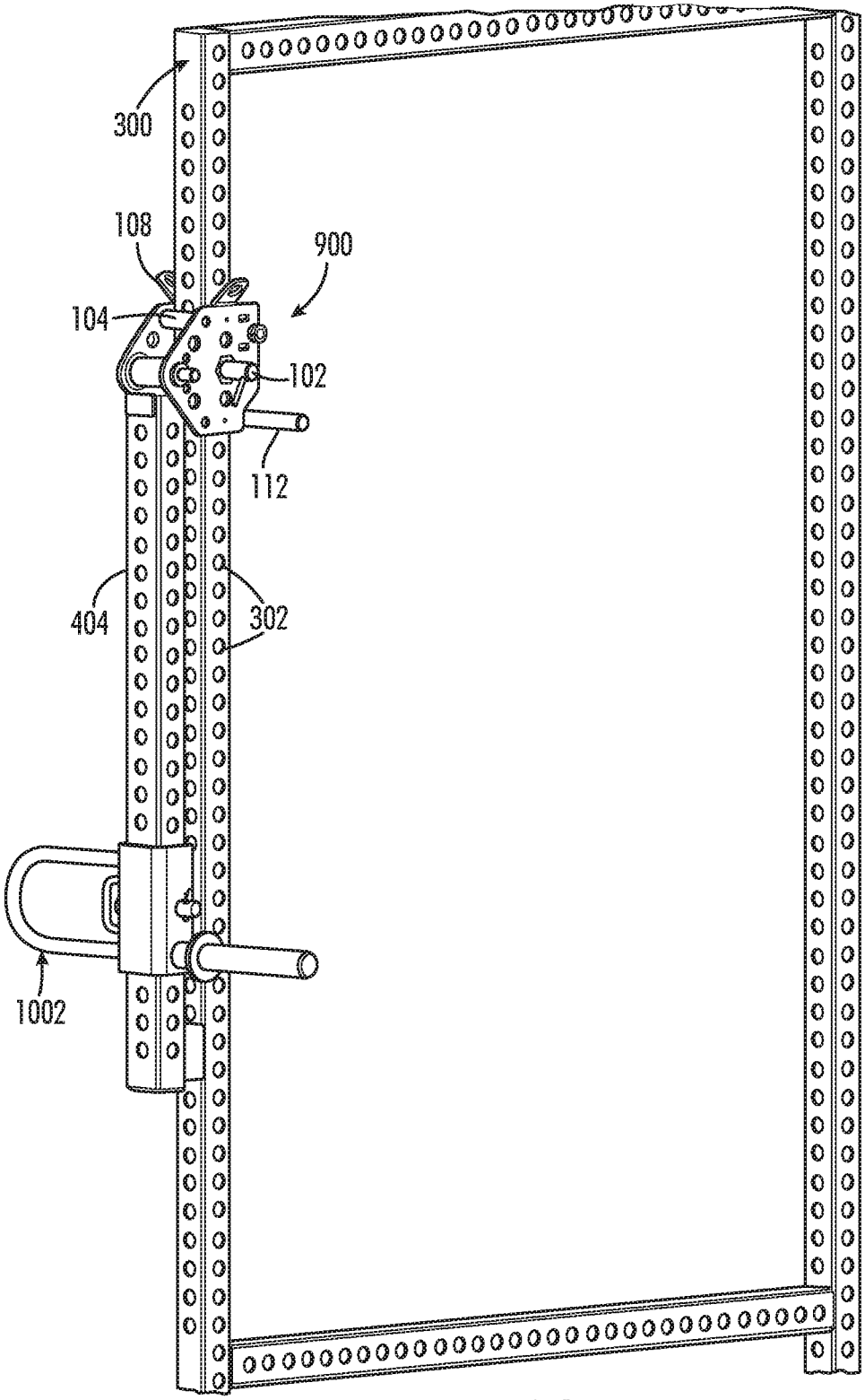

Of particular note, the moveable rack mount apparatus 100 of FIGS. 1A-1B, 2A-2C, 3-5 is configured with a left side layout, wherein the pop pin 102 is located on the outside of the rack when placed on the rack, whereas the moveable rack mount apparatuses 200, 900 shown in FIGS. 6, 9 and 10 are a right side layout. In some embodiments of the invention, the difference between the right side layout and the left side layout are that the pop pin 102 and the adjustment handle 202 are on opposite sides. In some embodiments of the invention, a right side layout could be used on either or both sides of the rack. In some embodiments of the invention a left side layout could be used on either or both sides of the rack. Optionally, the apparatuses 100, 200, 900 are configured such that the pop pin 102 and the adjustment handle 202 can be reversibly switched from side to side of the apparatus. It should be understood that description of features of one apparatus 100 are optionally applicable to apparatuses 200, 900 in a mirror-image fashion.

FIG. 2B shows the apparatus 100 from a bottom view where the tube passage 116 is more clearly shown and wherein the engaging pin 204 of the pop pin 102 is shown, the engaging pin 204 the portion of the pop pin 102 which is inserted into the rack hole to lock the apparatus 100 to the rack.

Figure 3:
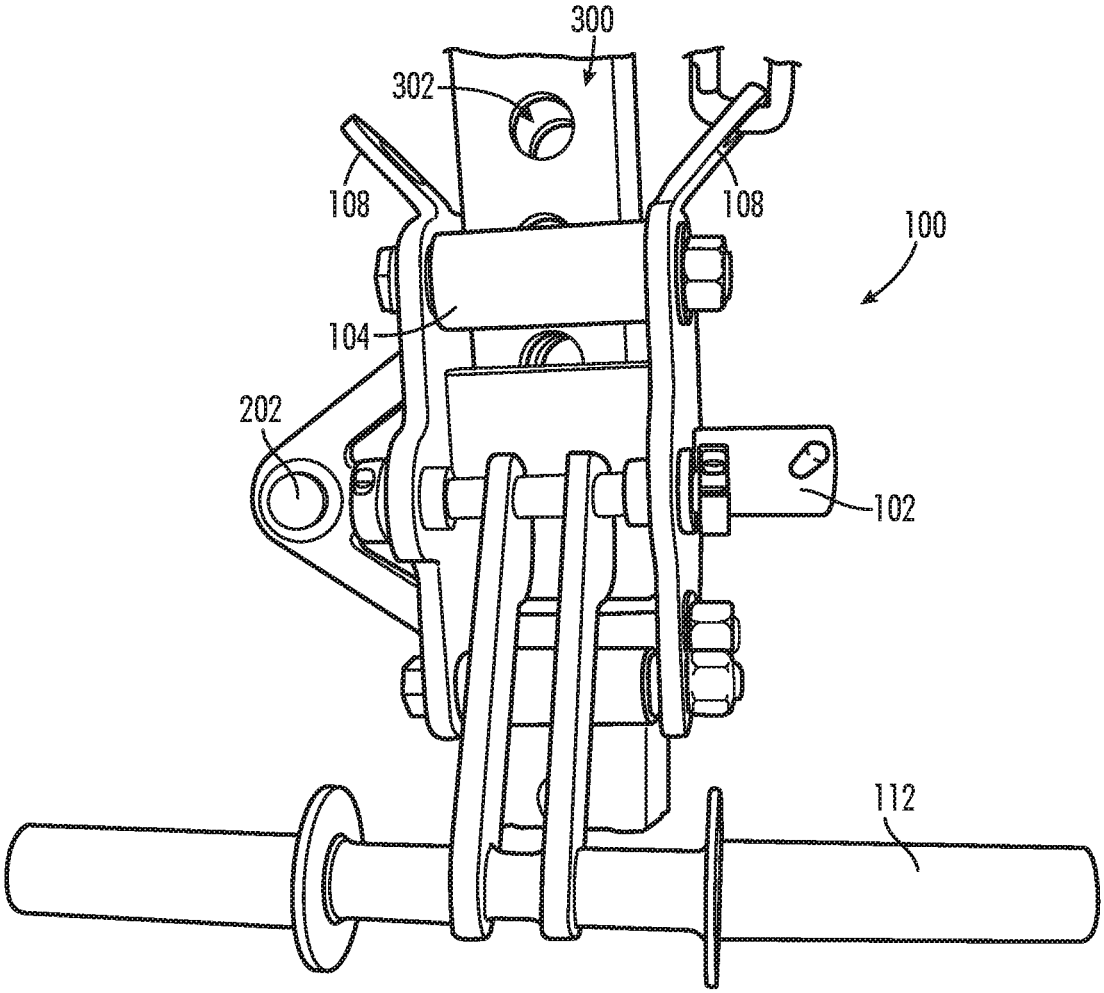
FIG. 3 is a rear view of a moveable rack mount apparatus on a rack, in accordance with an exemplary embodiment of the invention.

FIG. 3 is an image showing a rear view of the moveable rack mount apparatus 100 on a rack 300, in accordance with an exemplary embodiment of the invention. The pop pin 102 engages one of the rack holes 302 on the side of the rack facing the pop pin 102 to releasably lock the apparatus 100 to the rack 300.

Figure 4:
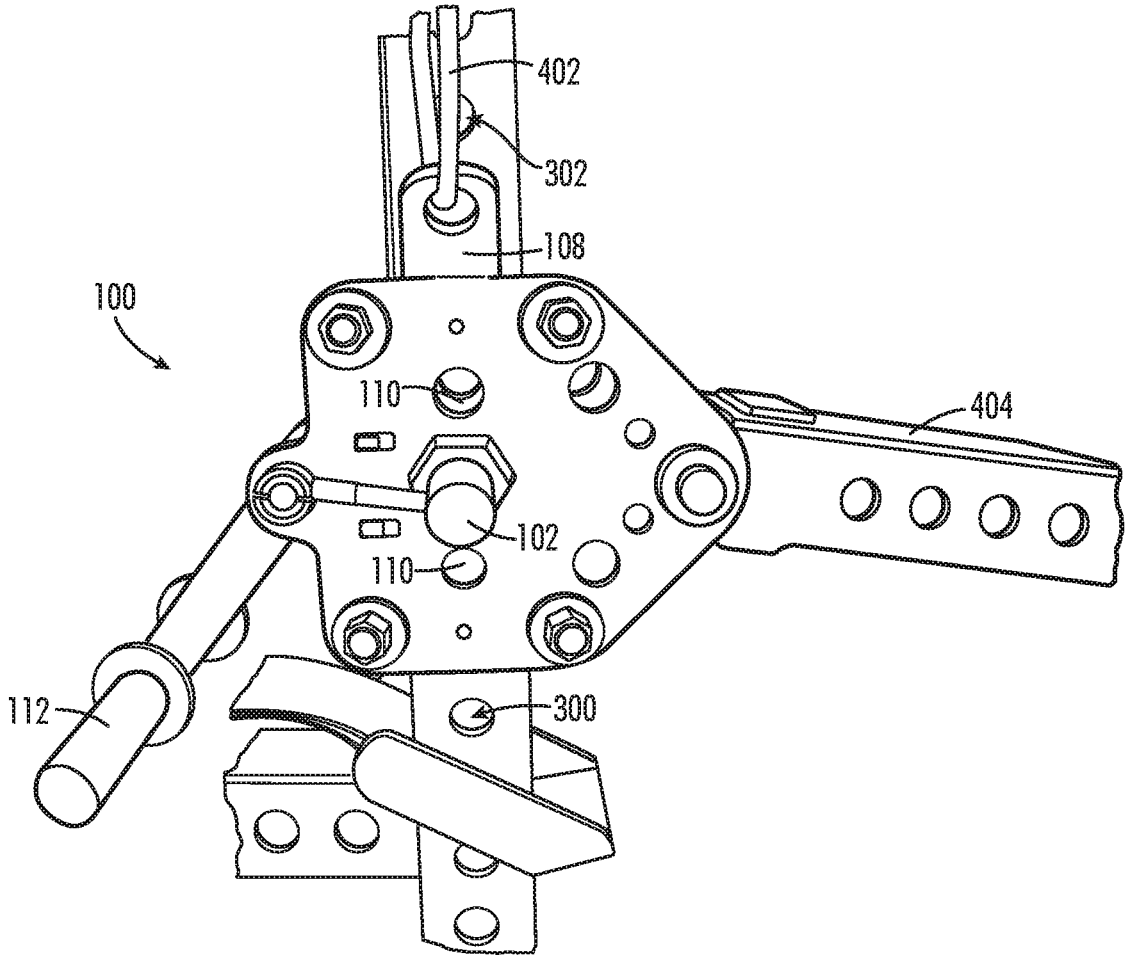
FIG. 4 is a left side view of a moveable rack mount apparatus on a rack, in accordance with an exemplary embodiment of the invention.

FIG. 4 is a left side view of the moveable rack mount apparatus 100, in accordance with an exemplary embodiment of the invention. The pop pin 102 is engaged with a rack hole 302 which cannot be seen from this view, but it can be seen that in some embodiments of the invention, the pin holes 110 of the apparatus 100 are aligned with the rack holes 302 of the rack 300, such that the pop pin 102 could be moved from one pin hole 110 to a different one and still lock the apparatus 100 to the rack 300. As described elsewhere herein, more than one pop pin 102 could be used to reinforce the connection. In some embodiments of the invention, a clip 402 attaches a band or strap to the band attachment point 108. Optionally, the band or strap is secured directly to the band attachment point 108. FIG. 4 also shows an exercise-related attachment 404 attached to the apparatus 100, and through the apparatus 100 to the rack 300. In an aspect of the invention, the exercise-related attachment is a lever arm, for example the Base Camp Jammer Arms™ available from Sorinex Exercise Equipment, Inc. It should be understood that racks and exercise-related attachments therefor are often designed to be modular and that while a lever arm is shown, the apparatuses 100, 200, 900 described herein could be used to connect any number of exercise-related attachments to a rack, for example safety bars, weighted attachments, attachments that require adjustment, or attachments which would otherwise be easy to steal by removing it from the rack (that is, attachments could be securely attached to the apparatus, using locks or similar devices).

Figure 5:
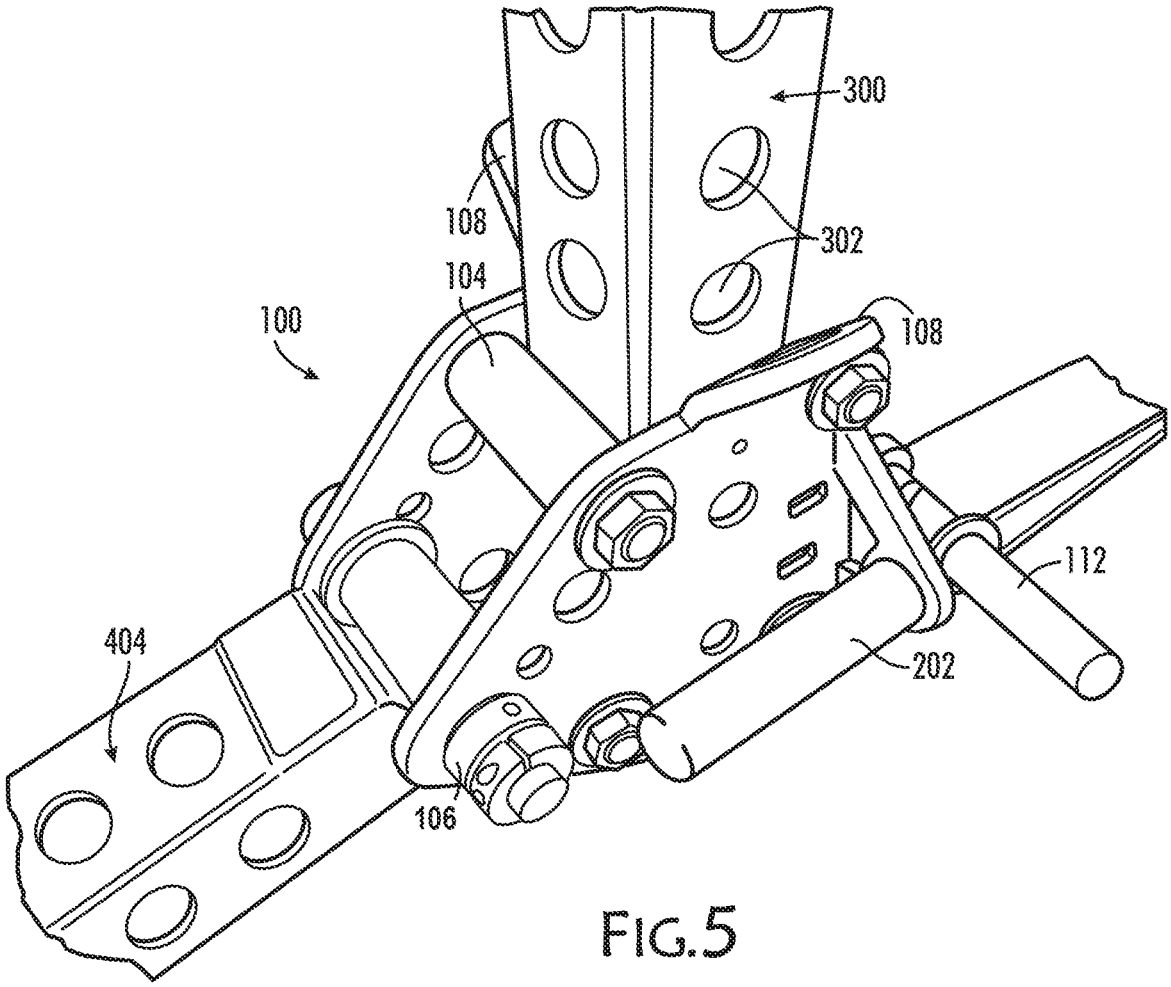
FIG. 5 is a top perspective view of a moveable rack mount apparatus on a rack, in accordance with an exemplary embodiment of the invention.

FIG. 5 is a top perspective view of moveable rack mount apparatus 100, in accordance with an exemplary embodiment of the invention.

FIG. 6 is an image of two moveable rack mount apparatuses 100, 200 in use, in accordance with an exemplary embodiment of the invention. Moveable rack mount apparatus 200 is a right side layout with the adjustment handle 202 on the inside of the right side of the rack 300 while the moveable rack mount apparatus 100 is a left side layout with the pop pin 102 on the outside of the left side of the rack 300. Two lever arms 404 are connected to the apparatuses 100, 200 and thereby to the rack 300. In use, the apparatus 100, 200 are slidable up and down 602 the rack 300 by pulling out the pop pin 102 on each side and sliding the apparatuses 100, 200 along the rack tubing to the desired position. No tools are needed for detaching the connection between the apparatuses 100, 200 and the rack 300 and re-attaching the connection between them.

FIG. 7 is an image of a right side layout moveable rack mount apparatus 100 in use, in accordance with an exemplary embodiment of the invention. A band 702 is attached to the apparatus 100 at the band attachment point 108.

Figure 8:
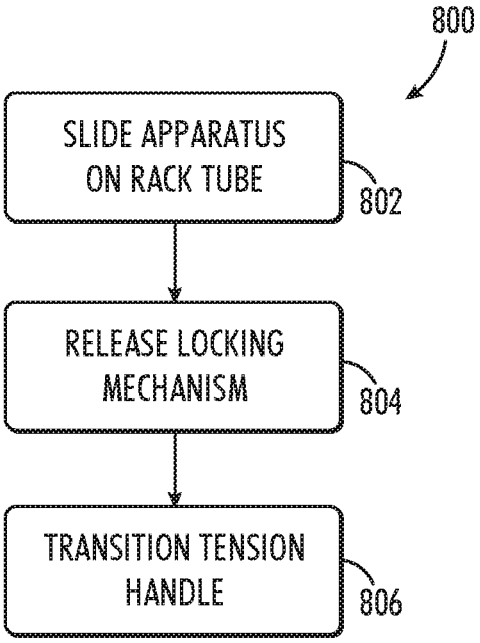
FIG. 8 is a flowchart of a method of using a moveable rack mount apparatus, in accordance with an exemplary embodiment of the invention.

FIG. 8 is a flowchart of a method 800 of using a moveable rack mount apparatus, in accordance with an exemplary embodiment of the invention. It should be understood that by conveniently connecting various exercise-related attachments to the rack using the moveable rack mounts described herein, a user does not have to waste time attaching and detaching, using tools, various exercise-related attachments in order to exercise. Further, different exercises at different angles to the user (e.g. shoulder press, incline press, chest press, row, shrug, squat, squat jump, kick back) can be commenced in relatively quick succession, without losing time to reconfiguring the exercise equipment.

In an embodiment of the invention, at least one moveable rack mount apparatus 100, 200 is placed on a rack tube prior to final assembly of the rack. The apparatus is slid (802) along the rack tube to a desired position with the locking mechanism (e.g. pop pin 102) in a disengaged configuration. Upon attaining a desired position, the pop pin 102 is released (804) so the engaging pin 204 inserts into a rack hole 302 to prevent relative movement between the apparatus 100, 200 and the rack 300. In some embodiments, the tensioning handle 112 is transitioned (806) from an un-tensioned position to a tensioned position to compress the rack 300 and further prevent relative movement between the apparatus 100, 200 and the rack 300. In some embodiments, transitioning the position of the tensioning handle from the un-tensioned position to the tensioned position is not needed to prevent movement of the apparatus 100 relative to the rack 300. To move the apparatus 100, 200 to a different desired position, the process is reversed, whereby the tensioning handle 112 is moved to an un-tensioned position, the pop pin 102 is disengaged from the rack hole 102, and the apparatus 100, 200 is slid along the rack tube to the different desired position. Upon attaining the different position, the pop pin 102 is engaged with the corresponding rack hole and the tensioning handle is re-engaged to further lock the apparatus 100, 200 to the rack 300.

FIG. 9 is a front, perspective view of a moveable rack mount apparatus 900, in accordance with an exemplary embodiment of the invention. The mount apparatus 900 shown in FIG. 9 has slight differences in comparison to the moveable rack mount apparatus 100 shown in FIGS. 1A-1B. For example, the rear surface of the mount apparatus 900 is shaped around the handle 112, rather than being a continuous flat rear surface such as shown with respect to the mount apparatus 100. As another example, the tension pivot 914 of the mount apparatus 900 is located higher with respect to the rear surface than with the mount apparatus 100, where the tension pivot 914 is approximately centered on the rear surface.

FIG. 10 is a perspective view of a moveable rack mount apparatus 900 mounting a lever arm 404 (along with some other equipment 1002) to a rack 300, in accordance with an exemplary embodiment of the invention. It should be understood that any of the moveable rack mount apparatuses 100, 200, 900 described herein are usable in this fashion. Typical racks 300 are made from 3 in.×3 in. rack tubing, often square. In some embodiments, the tube passage 116 is sized to accommodate rack tubing of this profile, but optionally with a tight tolerance, which is further reduced by using the tensioning handle 112 and/or different sleeves 118 to tighten the fit.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range. Further, described ranges are intended to include numbers outside any range described within statistical error and/or inherent measurement equipment limitations.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A moveable rack mount apparatus for use with an exercise rack constructed of at least one rack tube configured with at least one rack hole, comprising:

a main body, comprising two spaced-apart plates, forming a space therebetween, wherein the plates exhibit a taper towards a front of the main body;

a tube passage, disposed in the space between the plates, sized and shaped for slidable passage therethrough of the rack tube;

a reversible locking mechanism configured to engage the at least one rack hole of the rack tube when the rack tube is in the tube passage;

at least one attachment hole through the taper at the front of the main body for securing at least one of a plurality of interchangeable exercise-related attachments to the moveable rack mount apparatus; and, a handle located on the main body on a side opposite the at least one attachment hole.

2. The moveable rack mount apparatus according to claim 1, wherein the reversible locking mechanism comprises a pop pin.

3. The moveable rack mount apparatus according to claim 2, further comprising an engagement pin portion of the pop pin which is configured to engage the rack hole.

4. The moveable rack mount apparatus according to claim 2, further comprising a pin handle attached to the pop pin.

5. The moveable rack mount apparatus according to claim 1, further comprising at least one protective roller disposed proximal to the tube passage such that the rack tube when in the tube passage abuts the protective roller.

6. The moveable rack mount apparatus according to claim 5, wherein the at least one protective roller is at least one of smooth and flexible.

7. The moveable rack mount apparatus according to claim 1, wherein the main body has a general shape of a blunted triangle portion abutting one side of a quadrilateral portion.

8. The moveable rack mount apparatus according to claim 7, wherein the at least one attachment hole is located near an apex of the blunted triangle portion of the main body.

9. The moveable rack mount apparatus according to claim 1, wherein the handle is a tensioning handle shaped to reversibly apply compressive force on the rack tube when placed in a tensioned position.

10. The moveable rack mount apparatus according to claim 1, further comprising at least one band attachment point for safety and/or ease of using the moveable rack mount apparatus.

11. The moveable rack mount apparatus according to claim 1, wherein the reversible locking mechanism comprises a hitch pin.

12. The moveable rack mount apparatus according to claim 1, further comprising an adjustment handle.

13. The moveable rack mount apparatus according to claim 1, further comprising at least one sleeve on an interior surface of the tube passage.

14. The moveable rack mount apparatus according to claim 1, further comprising a plurality of pin holes for insertion of at least one reversible locking mechanism.

15. The moveable rack mount apparatus according to claim 1, wherein the plates are spaced apart by at least one protective roller.

16. The moveable rack mount apparatus according to claim 1, wherein at least one of the exercise-related attachments is a structural lever arm.

17. A method of using a moveable rack mount apparatus for use with an exercise rack constructed of at least one rack tube configured with at least one rack hole, comprising:

sliding the moveable rack mount apparatus including a main body comprising (a) two spaced-apart plates forming a space therebetween, wherein the plates exhibit a taper towards a front of the main body, (b) at least one attachment hole through the taper at the front of the main body, and (c) a handle located on the main body on a side opposite the at least one attachment hole, along the rack tube passing through a tube passage disposed in the space between the plates to a desired position using the handle, with a reversible locking mechanism disengaged; and, releasing the reversible locking mechanism to effectuate locking, such that movement between the moveable rack mount apparatus and the rack is prevented.

18. The method according to claim 17, further comprising securing at least one exercise-related attachment to the moveable rack mount apparatus through the at least one attachment hole.

19. The method according to claim 18, wherein the main body has a general shape of a blunted triangle portion abutting one side of a quadrilateral portion and wherein at least one exercise-related attachment is secured to through the at least one attachment hole near an apex of the main body.

20. The method according to claim 18, wherein the exercise-related attachment is a structural lever arm.

21. The method according to claim 17, wherein the handle is a tensioning handle shaped to reversibly apply compressive force on the rack tube when placed in a tensioned position.

22. The method according to claim 17, further comprising attaching the moveable rack mount apparatus to the exercise rack prior to final assembly of the exercise rack.

* * * * *